US005131221A

United States Patent [19]

Shekleton

[11] Patent Number: 5,131,221

[45] Date of Patent: Jul. 21, 1992

[54] INJECTOR CARBON SCREEN

[75] Inventor: Jack R. Shekleton, San Diego, Calif.

[73] Assignee: Sundstrand Corporation, Rockford, Ill.

[21] Appl. No.: 455,596

[22] Filed: Dec. 21, 1989

[51] Int. Cl.[5] ..... F02C 7/05

[52] U.S. Cl. ..... 60/39.091; 60/752; 60/760

[58] Field of Search ..... 60/752, 39.36, 39.11, 60/39.091, 39.092, 39.464, 760; 431/121, 252, 326; 239/575, 590, 590.5

[56] References Cited

U.S. PATENT DOCUMENTS

| | | | |
|---|---|---|---|
| 2,504,106 | 4/1950 | Berger | 60/752 |
| 2,586,751 | 2/1952 | Watson et al. | 60/39.65 |
| 3,726,087 | 4/1973 | Bryce | 60/756 |
| 4,141,213 | 2/1979 | Ross | 60/39.67 |
| 4,262,487 | 4/1981 | Glenn | 60/757 |
| 4,339,925 | 7/1982 | Eggmann et al. | 60/760 |

FOREIGN PATENT DOCUMENTS

| | | | |
|---|---|---|---|
| 57-67713 | 4/1982 | Japan | 431/121 |

*Primary Examiner*—Richard A. Bertsch
*Assistant Examiner*—Timothy S. Thorpe
*Attorney, Agent, or Firm*—Wood, Phillips, VanSanten, Hoffman & Ertel

[57] ABSTRACT

In order to avoid plugging the air passageways (70) of fuel injectors (42) with carbon particles in a gas turbine engine (10), the gas turbine engine (10) includes an annular combustor (18) having radial dilution air injection. The gas turbine engine (10) also includes a rotor (12) having turbine blades (14) and a nozzle (16) adjacent the turbine blades (14) which is adapted to direct hot gases at the turbine blades (14) to cause rotation of the rotor (12). The annular combustor (18) is disposed about the rotor (12) and has an outlet (20) to the nozzle (16), spaced inner and outer walls (22 and 24), and a generally radially extending wall (26) connecting the inner and outer walls (22 and 24). The gas turbine engine (10) further includes a housing (28) substantially surrounding the annular combustor (18) in spaced relation to the inner, outer, and radially extending walls (22, 24 and 26) to define a dilution air flow path (30). The annular combustor (18) further includes a combustion annulus (36) defined by the inner, outer, and radially extending walls (22, 24 and 26, respectively), and a plurality of radially disposed air blast fuel injectors (42). The gas turbine engine (10) also includes dilution air holes (48, 52 and 56) for bleeding air into the combustion annulus (36) to produce a localized cooling air film on the inwardly facing surfaces of the inner, outer and radially extending walls (22, 24 and 25, respectively). With this arrangement, the gas turbine engine includes screens or mesh for preventing matter potentially obstructive to the fuel injector air passageway from passing from a dilution air hole into a fuel injector air passageway.

12 Claims, 1 Drawing Sheet

INJECTOR CARBON SCREEN

FIELD OF THE INVENTION

This invention relates to gas turbine annular combustors and more particularly to an annular combustor having an air blast fuel injector in which carbon plugging is substantially reduced.

BACKGROUND OF THE INVENTION

Gas turbine engines typically include a combustor in which carbonaceous fuel is combusted with an oxidant, most usually air, to produce hot gases of combustion. Most frequently the hot gases of combustion are thereafter diluted with cooler air and then directed through a turbine nozzle which in turn directs the gases against a turbine wheel to drive the same. Large temperature gradients and high operating temperatures in those parts of turbine engines subjected to the hot gases of combustion have long been known to be undesirable. Large temperature gradients are undesirable because of large internal stresses that are generated when one part of a component operates at one temperature and another part operates at a substantially different temperature due to the differences in thermal expansion. The high temperature gas may require the use of exotic materials in constructing turbine components in order to withstand fatigue, and the use of such materials substantially increases the cost of building a turbine.

Consequently it is customary to inject so called "dilution air" into the gases of combustion prior to their application to the turbine wheel and the turbine nozzle which directs the gases thereat. Typically, it is desired to achieve a uniform circumferential mixing of the dilution air with the gases of combustion which produces a specific shape of radial temperature profile at the turbine wheel inlet which is usually not flat. In an optimal case there will be a complete mixing of the dilution air with the gases of combustion such that a uniform temperature of a stream of combined gases of combustion and dilution air is achieved. When and if such a state can occur, the operating temperature of the component can be adequately regulated by controlling, through suitable design parameters, the amount of dilution air in proportion to the gases of combustion. At the same time, severe temperature gradients will be nonexistent because all parts of the gas stream being applied to the turbine nozzle and thus to the turbine wheel will be at substantially equal temperatures.

Perfect circumferential mixing cannot be obtained in practice although it may be approached in large size turbines. This follows because the size of the components is such that there is substantial residence time of combustion gases and dilution air in a combustor or the like prior to the application to a turbine nozzle so as to allow fairly thorough mixing. However, in other cases the residence time is extremely short and adequate mixing will not necessarily occur without undesirably increasing the size of the components.

In order to aid in the attainment of desired temperature gradients within the combustor, dilution air can be injected into the combustion chamber. This can be done so as to produce a localized cooling air film on the inwardly facing surfaces or walls of the combustion chamber. As will be appreciated, these dilution air holes help to maintain as close as possible uniform and acceptable temperature gradients within combustion chambers.

Another problem is intertwined with the problem already discussed hereinabove. During the combustion process there is a tendency for carbon build-up to occur as a result of incomplete combustion. Such is undesirable from the standpoint that incomplete combustion reduces the efficiency of operation of the turbine. From another viewpoint, this is even more undesirable since pieces of carbon may break off and be swept throughout the engine. Such carbon can cause erosion of engine parts and reduce the life of the engine.

The carbon build-up can be especially acute at or near the parts of the combustion chamber in which dilution air is introduced since particularly in this area the temperature will unavoidably be less than elsewhere in the combustion chamber. Insufficient vaporization of the hydrocarbon fuel often results due to relatively low combustor wall temperatures, low vapor pressure of heavy liquid fuels used and low residence time within the combustor. As turbine engines use heavier molecular weight fuels the problem of elemental carbon formation becomes even more pronounced. These factors frequently result in liquid fuel droplets impacting and attaching to the relatively cool combustor wall and once the droplets attach to the combustor wall, combustion reactions will not proceed to completion but, instead, decomposition of the hydrocarbon molecules will leave carbon at the wall which may grow to become very large deposits. While one undesirable aspect of the carbon build-up is that it may interfere with heat transfer, the more serious problem is that the carbon may break free and damage engine parts.

In air blast fuel injectors, the air passageways are susceptible to being plugged by carbon lumps from carbon which has formed on internal combustor walls and which fall out of a combustor through a dilution air hole. This may typically occur when the engine is shut down, or as the engine is in the process of being shut down, whereupon in a subsequent restart, the carbon can be carried forward by the incoming air to lodge in a fuel injector's air passageway. Obviously if the air blast fuel injector air passageway is blocked, poor fuel atomization will occur and, consequently poor engine performance will result.

The present invention is directed in overcoming one or more of these problems.

SUMMARY OF THE INVENTION

It is a principal object of the present invention to provide a gas turbine engine which successfully prevents carbon, and especially carbon particles, from plugging an air blast fuel injector which is downstream of a dilution air hole through which the particles may pass. More specifically, it is an object of the invention to provide a combustor with a screen or mesh sized to catch the particles wherein the screen or mesh is placed between the fuel injector and the dilution air hole. It is still further an object of the present invention to provide a combustor designed such that the dilution air hole or holes are located downstream of the effectable air blast fuel injectors wherein carbon particles cannot reach the injectors.

In an exemplary embodiment, a gas turbine engine includes a rotor having turbine blades and a nozzle adapted to direct hot gases to the turbine blades to cause rotation of the rotor. The engine also includes an annular combustor about the rotor having an outlet to the nozzle. The combustor has spaced inner and outer walls connected by a generally radially extending wall to define a combustion annulus upstream of the outlet. A housing substantially surrounds the annular combustor in spaced relation to the walls of the combustor to define a dilution air flow path extending substantially entirely about the combustor. The engine also includes at least one air blast fuel injector and at least one dilution air hole in fluid communication with said fuel injector. The fuel injector has an air passageway in fluid communication with the dilution air flow path. With this arrangement, the engine also includes means for preventing matter potentially obstructive to the fuel injection air passageway from passing from the dilution air hole into the fuel injection air passageway.

In a highly preferred embodiment, the dilution air hole is upstream of the fuel injector and a screen is located over the dilution air hole, about the air blast fuel injector, and/or in the flow path between the two. The mesh or screen is sized so that fine particles pass through while preventing passage of large lumps. Also because of the porosity of the mesh no appreciable restriction to air flow results and, advantageously, the mesh has openings of approximately one-half the size of the injector air passageway.

Other objects, advantages and features of the present invention will become apparent from the following specification taken in conjunction with the accompanying drawings.

DETAILED DESCRIPTION OF THE PREFERRED EMBODIMENT

Figure 1:
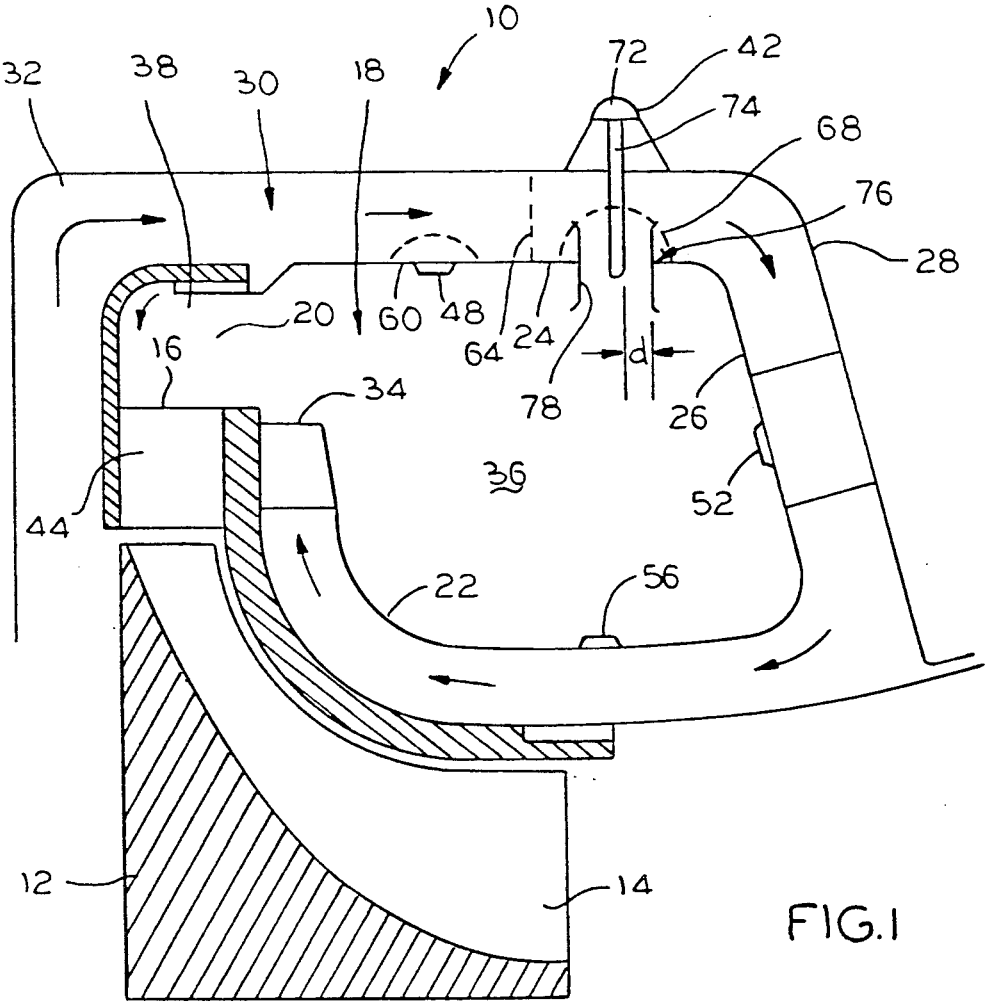
FIG. 1 is a somewhat schematic fragmentary sectional view of a gas turbine engine constructed in accordance with the present invention.

An exemplary embodiment of a gas turbine engine constructed in accordance with the invention is illustrated in the drawings. However, the invention is not so limited, having applicability to any form of turbine or other fuel combusting device. In fact, the invention is suited for preventing potentially obstructive matter from passing into any fuel injector air passageway.

Referring to FIG. 1, the reference numeral 10 designates generally a gas turbine engine shown herein for illustration purposes as being of the radial flow type and having a rotor 12 with turbine blades 14 and a turbine nozzle 16 adapted to direct hot gases at the turbine blades 14 to cause rotation of the rotor 12. In addition, the gas turbine 10 includes an annular combustor generally designated 18 about the rotor 12 and having an outlet 20 to the nozzle 16, spaced inner and outer walls 22 and 24, respectively, and a generally radially extending wall 26 connecting the inner and outer walls 22 and 24.

A housing 28 substantially surrounds the annular combustor 18 in spaced relation to the inner, outer and radially extending walls 22, 24 and 26, respectively, to define a dilution air flow path generally designated 30. The dilution air flow path 30 includes a compressed air inlet as at 32 in communication with a compressor (not shown) supplying air at one end thereof and a compressed air outlet 34 in communication with the annular combustor 18 adjacent the outlet 20 at the other end thereof. As will be seen, the dilution air flow path 30 extends substantially entirely about the annular combustor 18 to cool the inner, outer, and radially extending walls 22, 24 and 26 respectively.

As shown in FIG. 1, the annular combustor 18 includes a combustion annulus or combustion chamber 36 generally defined by the inner, outer, and radially extending walls 22, 24 and 26, respectively. This combustion annulus or chamber 36 is disposed upstream of the outlet 20 of the annular combustor 18 and, as a result, the compressed air outlet 34 is in communication with the annular combustor 18 downstream of the combustion annulus or chamber 36 closely adjacent the nozzle 16. Furthermore, as shown, an annulus 38 is disposed between the combustion annulus or chamber 36 and the turbine nozzle 16 in the region of the outlet 20 of the annular combustor 18, i.e., the outlet 20 of the annular combustor 18 leads to the nozzle 16 through the annulus 38.

In this particular embodiment, all of the hot gases exiting from the combustion annulus or chamber 36 pass through the annulus 38 where dilution air is injected into the hot gases. The dilution air is provided and delivered through the compressed air outlet 34 prior to entry of the hot gases into the nozzle 16. For this reason, the hot gases in this particular embodiment are cooled by and mixed with the dilution air thoroughly thereby protecting the downstream components from temperature extremes.

Figure 2:
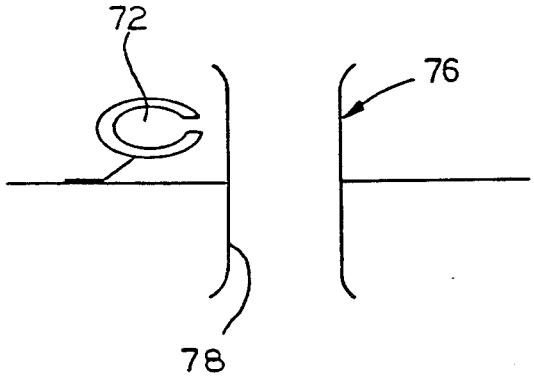
FIG. 2 is a somewhat schematic fragmentary sectional view of an air blast fuel injector for the gas turbine engine of FIG. 1..

As shown in FIGS. 1 and 2, the annular combustor 18 will preferably include a plurality of radially disposed fuel injectors 42 which are conventional air blast fuel injectors. They serve to spray a fuel/air mixture into the combustion annulus or chamber 36 in a tangential direction where it will be burned to produce the hot gases needed to drive the turbine blades 14. As will be appreciated, it is the hot gases of combustion that are mixed with the dilution air in the annulus 38 prior to entry into the nozzle 16 and contact with the nozzle blades 44 and the turbine blades 14.

The gas turbine engine 10 also includes small openings in the form of radially disposed dilution air holes as illustrated schematically, for instance, at 48, 52 and 56, to bleed air into the combustion annulus or chamber 36 to produce a localized cooling air film on the inwardly facing surfaces of the inner, outer and radially extending walls 22, 24 and 26, respectively.

The annular combustor 18 also includes a plurality of separate screens or meshes 60, 64 and 68 which are strategically placed in the dilution air flow path 30 between, in this case, the dilution air holes 48 and the air blast fuel injectors 42. As will be appreciated from FIGS. 1 and 2, the screens 60 are placed about the dilution air holes 48, while the screens 64 are placed directly in the dilution air flow path 30, and while the screens 68 are placed over the fuel injectors 42 substantially as shown.

While in this instance all three types of screens have been illustrated, this is merely for purposes of illustrating the various possibilities, since it is actually necessary to use only a single one of the screens to effectuate the desired result. The mesh should be coarse in size to catch the carbon particles which could otherwise possibly plug up the air passageways in the fuel injectors 42 while still not significantly restricting the air flow therethrough. In practice, a mesh hole size of about one-half of the radial size 'd' of the air passageway 70 of the fuel injector 42, will allow fine particles and air to pass through while preventing passage of large carbon lumps.

As for the fuel injector 42, it can take the form of any of a number of different type of air blast injectors. Thus, it may include a fuel manifold 72 in communication with a fuel delivery tube 74 within each of said air blast tubes 76 which each comprise a preselected size opening 78 defining an air passageway in communication with the dilution air flow path 30 substantially as shown in FIG. 1. Alternatively, The fuel manifold 72 may communicate directly with the air blast tubes 76 as shown in FIG. 2

In practice, the carbon particles may provide problems especially when the gas turbine engine 10 is shut down at which time the particles may pass through one or more of the dilution air holes such as 48 into the dilution air flow path 30 at a point upstream of the fuel injectors 42. Then, upon restart, the carbon particles can be carried forward by the incoming air in the dilution air flow path 30 to lodge in one of the air passageways 70 of the fuel injectors 42. Without one or more of the types of screens 60, 64 and 68, the carbon lumps could disrupt the air flow through the air passageways 70 of some of the fuel injectors 42 causing poor fuel atomization and, possibly, resulting in a long flame which could produce a dangerous hot spot at a critical location within the engine.

While in the foregoing there has been set forth a preferred embodiment of the invention, it will be understood that the details herein given are for purposes of illustration and the invention is only to be limited by the spirit and scope of appended claims.

I claim:

1. A gas turbine engine, comprising:

a rotor including turbine blades and a nozzle adjacent said turbine blades, said nozzle being adapted to direct hot gases of combustion to said turbine blades to cause rotation of said rotor about an axis;

an annular combustor about said axis and having an outlet to said nozzle, said annular combustor having spaced inner and outer walls interconnected by a generally radially extending wall, said inner wall being closer to said axis than said outer wall and said radially extending wall extends in a generally radial direction from said axis, said annular combustor also including a combustion annulus defined by said inner, outer and radially extending walls, said outlet being disposed between said combustion annulus and said nozzle;

a housing substantially surrounding said annular combustor in spaced relation to said inner, outer, and radially extending walls thereof, said housing defining a dilution air flow path including a compressed air inlet in communication with a source of compressed air supplying dilution air at one end thereof and a compressed air outlet in communication with said annular combustor adjacent said outlet at the other end thereof, said dilution air flow path extending substantially entirely about said annular combustor;

at least one fuel injector positioned to inject air and fuel into said combustion annulus, said fuel injector having an air passageway defined by a preselected size opening, said fuel injector being in fluid communication with said dilution air flow path and a fuel supply tube;

at least one dilution air hole positioned between said compressed air inlet and said fuel injector and accommodating communication of said dilution air flow path and said combustion annulus therethrough; and a screen in said dilution air flow path so as to be positioned between said dilution air hole and said fuel injector, said screen having a mesh size selected relative to said preselected size opening in said passageway of said fuel injector, said mesh size being selected to prevent clogging of said air passageway by particulate matter from said combustion annulus, said mesh size of said screen being approximately one-third the size of said preselected size opening defining said fuel injector.

2. The gas turbine engine of claim 1 wherein said dilution air hole is disposed in one of said walls.

3. The gas turbine engine of claim 2 wherein said screen is placed over said dilution air hole.

4. The gas turbine engine of claim 2 wherein said screen is placed over said air passageway at a point adjacent said fuel injector.

5. The gas turbine engine of claim 2 wherein said screen is placed in said dilution air flow path between said dilution air hole and said fuel injector.

6. The gas turbine engine of claim 1 wherein said screen is placed over said dilution air hole.

7. The gas turbine engine of claim 1 wherein said screen is placed in said dilution air flow path between said dilution air hole and said fuel injector.

8. The gas turbine engine of claim 1 wherein said screen is placed over said preselected size opening defining said air passageway of said fuel injector.

9. A gas turbine engine, comprising:

a rotor including turbine blades and a nozzle adjacent said turbine blades, said nozzle being adapted to direct hot gases of combustion to said turbine blades to cause rotation of said rotor about an axis;

an annular combustor about said axis and having an outlet to said nozzle, said annular combustor having spaced inner and outer walls interconnected by a generally radially extending wall, said inner wall being closer to said axis than said outer wall and said radially extending wall extends in a generally radial direction rom said axis, said annular combustor also including a combustion annulus defined by said inner, outer and radially extending walls, said outlet being disposed between said combustion annulus and said nozzle;

a housing substantially surrounding said annular combustor in spaced relation to said inner, outer, and radially extending walls thereof, said housing defining a dilution air flow path including a compressed air inlet in communication with a source of compressed air supplying dilution air at one end thereof and a compressed air outlet in communication with said annular combustor adjacent said outlet at the other end thereof, said dilution air flow path extending substantially entirely about said annular combustor;

at least one fuel injector positioned to inject air and fuel into said combustion annulus, said fuel injector having an air passageway defined by a preselected size opening, said fuel injector being in fluid communication with said dilution air flow path and a fuel supply tube;

at least one dilution air hole positioned between said fuel injector and said compressed air outlet and accommodating communication of said dilution air flow path and said combustion annulus therethrough; and a screen in said dilution air flow path so as to be positioned between said dilution air hole and said fuel injector, said screen having a mesh size selected relative to said preselected size opening in said air passageway of said fuel injector, said mesh size being selected to prevent clogging of said air passageway by particulate matter from said combustion annulus, said mesh size of said screen being approximately one-third the size of said preselected size opening defining said fuel injector.

10. The gas turbine engine of claim 9 wherein said screen is placed over said dilution air hole.

11. The gas turbine engine of claim 9 wherein said screen is placed in said dilution air flow path between said dilution air hole and said fuel injector.

12. The gas turbine engine of claim 9 wherein said screen is placed over said preselected size opening defining said air passageway of said fuel injector.

* * * * *